US006273547B1

(12) United States Patent
Aldrich

(10) Patent No.: US 6,273,547 B1
(45) Date of Patent: Aug. 14, 2001

(54) WASTE INK COLLECTION SYSTEM FOR AN INK JET PRINTER

(75) Inventor: Charles Stanley Aldrich, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/427,799

(22) Filed: Oct. 27, 1999

(51) Int. Cl.[7] ..... B41J 2/165
(52) U.S. Cl. ..... 347/36; 347/29; 347/33
(58) Field of Search ..... 347/36, 29, 33, 347/35

(56) References Cited

U.S. PATENT DOCUMENTS

| | | | |
|---|---|---|---|
| 4,558,326 | 12/1985 | Kimura et al. | 347/36 |
| 4,701,771 | 10/1987 | Ikeda | 347/30 |
| 5,517,222 | 5/1996 | Sugiyama et al. | 347/35 |
| 5,614,930 | 3/1997 | Osborne et al. | 347/33 |
| 5,617,124 | 4/1997 | Taylor et al. | 347/35 |
| 5,712,668 | 1/1998 | Osborne et al. | 347/32 |
| 5,742,303 | 4/1998 | Taylor et al. | 347/36 |

*Primary Examiner*—N. Le
*Assistant Examiner*—Shih-wen Hsieh
(74) *Attorney, Agent, or Firm*—Jacqueline M. Daspit; Ronald K. Aust

(57) ABSTRACT

A maintenance station for an ink jet printer includes a frame and a device, such as for example a cylindrical drum, rotatably coupled to the frame for collecting waste ink. A ratchet drive assembly is coupled to the frame for effecting rotation of the device. The ratchet drive assembly includes a ratchet gear coupled to the device, wherein the ratchet gear has a plurality of teeth. A distal end of a back-check member engages the teeth of the ratchet gear for effecting a rotation of the device in a first direction and prevents a rotation of the device in a direction opposite to the first direction. The rotation of the device is effected as the printhead cap is moved in a vertical direction.

22 Claims, 4 Drawing Sheets

WASTE INK COLLECTION SYSTEM FOR AN INK JET PRINTER

BACKGROUND OF THE INVENTION

1. Field of the Invention

The present invention relates to the handling of waste ink accumulated in an ink jet printer system, and more particularly, to an apparatus for decreasing ink misting during a printhead nozzle purge operation.

2. Description of the Related Art

Ink jet printers require maintenance operations to keep the nozzles of the print cartridge operating properly. Such maintenance operations typically include the steps of wiping the nozzle area of the print cartridge, firing the nozzles at prescribed intervals to purge the nozzles (spitting), and capping the cartridge during idle periods to prevent the jetted ink which remains on the nozzle plate from drying and clogging one or more of the nozzles of the nozzle plate. Typically, the spitting operation occurs at a location in the maintenance station. Over a period of time, the solids in the waste ink accumulate in the maintenance station, and the resulting waste ink build-up can affect the operation of the maintenance assembly.

Ink jet printers have been plagued with the problem of ink mist from maintenance operations drifting around and landing on the print media which is being printed. The mist is generated when the printer stops periodically to clean and clear the printing nozzles by spitting ink. When the printer resumes printing on the print media, airborne mist from the maintenance operation is drawn by the carrier movement and drifts onto the paper. This results in a noticeable image defect on the paper, and tends to also contaminate other printer mechanisms.

One previous attempt to control and collect the mist ink is to perform the spitting operation on-page. Other printers have used fans and absorbent pads in attempts to collect and contain the mist ink. However, with the more prevalent use of higher non-volatile constituents in ink formulations, residual or waste ink build-up interferes with the operation of printing by contaminating the printheads. Furthermore, passive collection systems, such as pads and venturies, have limited effectiveness and limited capability to store non-volatile waste ink. Active systems, such as fans, can be effective, but are complex and expensive to implement.

Other attempts have included providing a rotating annular wheel for receiving waste ink discharged by an ink jet printhead which is driven by a rotary capping assembly which is rotated by a motor and gear or belt. Such a configuration, however, is not readily adaptable for use with sled-type maintenance assemblies, since such sled-type maintenance assemblies do not include a source of rotary motion. In addition, a curvature of the annular wheel is not uniformly spaced from the generally parallel columns of nozzles of the printhead, thereby limiting its effectiveness for waste ink mist recovery.

Accordingly, a need exists for a printing system which includes a simple and effective drive mechanism to provide rotary power to a sled-type maintenance assembly and provides improved waste ink mist recovery.

SUMMARY OF THE INVENTION

One aspect of the invention is a maintenance station for an ink jet printer which includes a frame. A device, such as for example a cylindrical drum, is rotatably coupled to the frame for collecting waste ink. A ratchet drive assembly is coupled to the frame for effecting rotation of the device.

In preferred embodiments of the invention, the ratchet drive assembly includes a ratchet gear coupled to the device, wherein the ratchet gear has a plurality of teeth. A distal end of a back-check member engages the teeth of the ratchet gear for effecting a rotation of the device in a first direction. The back-check member effects the rotation of the device in the first direction and prevents a rotation of the device in a direction opposite to the first direction. Also, preferably, rotation of the device is effected as the printhead cap is moved in a vertical direction.

Another aspect of the invention is a maintenance station for an ink jet printer having a carriage assembly for moving an ink jet printhead along a linear scanning path. The ink jet printhead includes a column of nozzles. The maintenance assembly includes a frame and a printhead capping assembly coupled to the frame. The printhead capping assembly has a printhead cap for engaging the printhead during a capping operation. The printhead capping assembly is located on the frame along the linear scanning path of the ink jet printhead. A cylindrical drum having a cylindrical surface is rotatably coupled to the frame and positioned adjacent the printhead capping assembly. The cylindrical drum is orientated such that an axis of rotation of the cylindrical drum is substantially perpendicular to the linear scanning path of the ink jet printhead. The orientation may also provide a substantially uniform spacing between the column of printhead nozzles and the cylindrical surface of the cylindrical drum.

Still another aspect of the invention is a printer for printing with an ink jet printhead. The printer includes a printer frame, and a carriage assembly coupled to the printer frame, wherein the carriage assembly moves the ink jet printhead along a linear scanning path. A maintenance assembly frame is coupled to the printer frame. A device, such as a cylindrical drum, is rotatably coupled to the maintenance frame for collecting waste ink ejected by said printhead. A ratchet drive assembly is coupled to the maintenance frame for effecting rotation of the device.

An advantage of the present invention is the inclusion of a rotatable cylindrical drum for controlling misting and a rotary drive therefor for use in a maintenance assembly having a maintenance sled which moves in a substantially linear motion.

Another advantage is that the rotatable cylindrical drum is oriented to provide a uniform spacing between the columns of printhead nozzles and a cylindrical surface of the cylindrical drum to thereby effectively control ink misting during a printhead nozzle purge operation.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Figure 1:
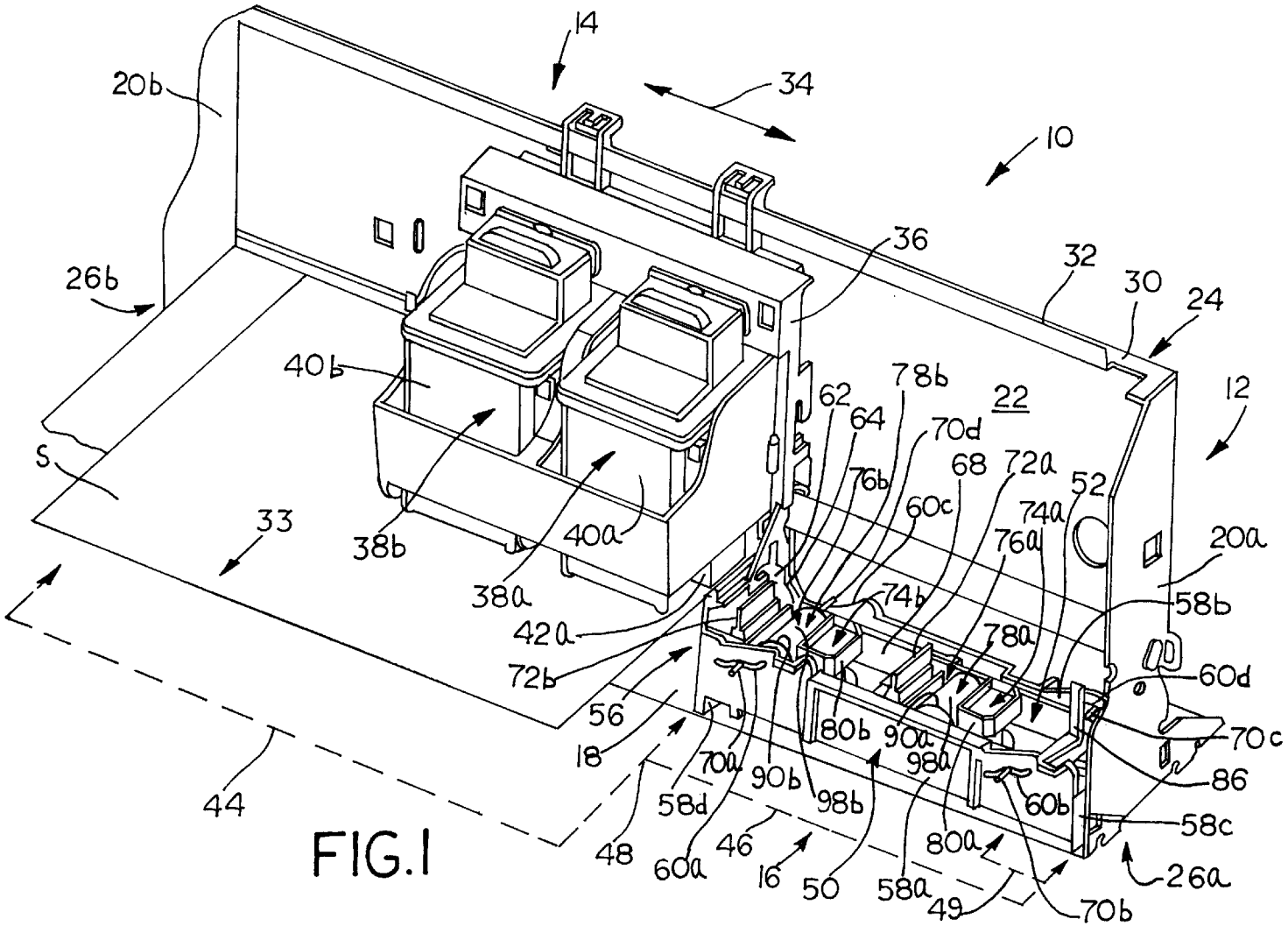
FIG. 1 is a partial, perspective view of the frame assembly of an ink jet printer including a maintenance assembly in accordance with the invention.

Corresponding reference characters indicate corresponding parts throughout the several views. The exemplifications set out herein illustrates one preferred embodiment of the invention, in one form, and such exemplifications are not to be construed as limiting the scope of the invention in any manner.

DETAILED DESCRIPTION OF THE INVENTION

Referring now to the drawings and particularly to FIG. 1, there is shown a portion of an ink jet printer 10 which includes a printer frame 12, a printhead carrier assembly 14, and a maintenance assembly 16 in accordance with the present invention. Positional terms such as left, right, top, bottom, upper, lower, clockwise or counter-clockwise are assigned based on the orientation of printer 10 in FIG. 1 and should not be considered limiting terminology.

Printer frame 12 includes a bottom frame member 18, two side frame members 20*a,* 20*b,* a rear frame member 22, and a top frame member 24. Side frame members 20*a,* 20*b* are attached to, and extend generally vertically upwardly from, opposing ends 26*a,* 26*b,* respectively, of bottom frame member 18. Top frame member 24 is mounted and positioned generally parallel to bottom frame member 18. Rear frame member 22 is disposed between side frame members 20*a,* 20*b,* generally above bottom frame member 18 and below top frame member 24.

Top frame member 24 includes a horizontally extending guide portion 30 and a vertically upwardly extending guide rail 32 disposed at the rear side of guide portion 30. Guide rail 32 is adapted to slidably receive printhead carrier assembly 14 and permit reciprocating movement of printhead carrier assembly 14 in relation to guide rail 32 in a linear scanning path in the directions depicted by arrows 34, which is substantially perpendicular to a sheet (S) feed direction 33.

Printhead carrier assembly 14 includes a carriage 36 which holds two print cartridges 38*a,* 38*b,* wherein print cartridge 38*a* contains magenta, yellow and cyan colored pigment based inks and print cartridge 38*b* contains a black dye based ink. In general, pigment based inks contain more solid components than dye based inks.

Figure 2:
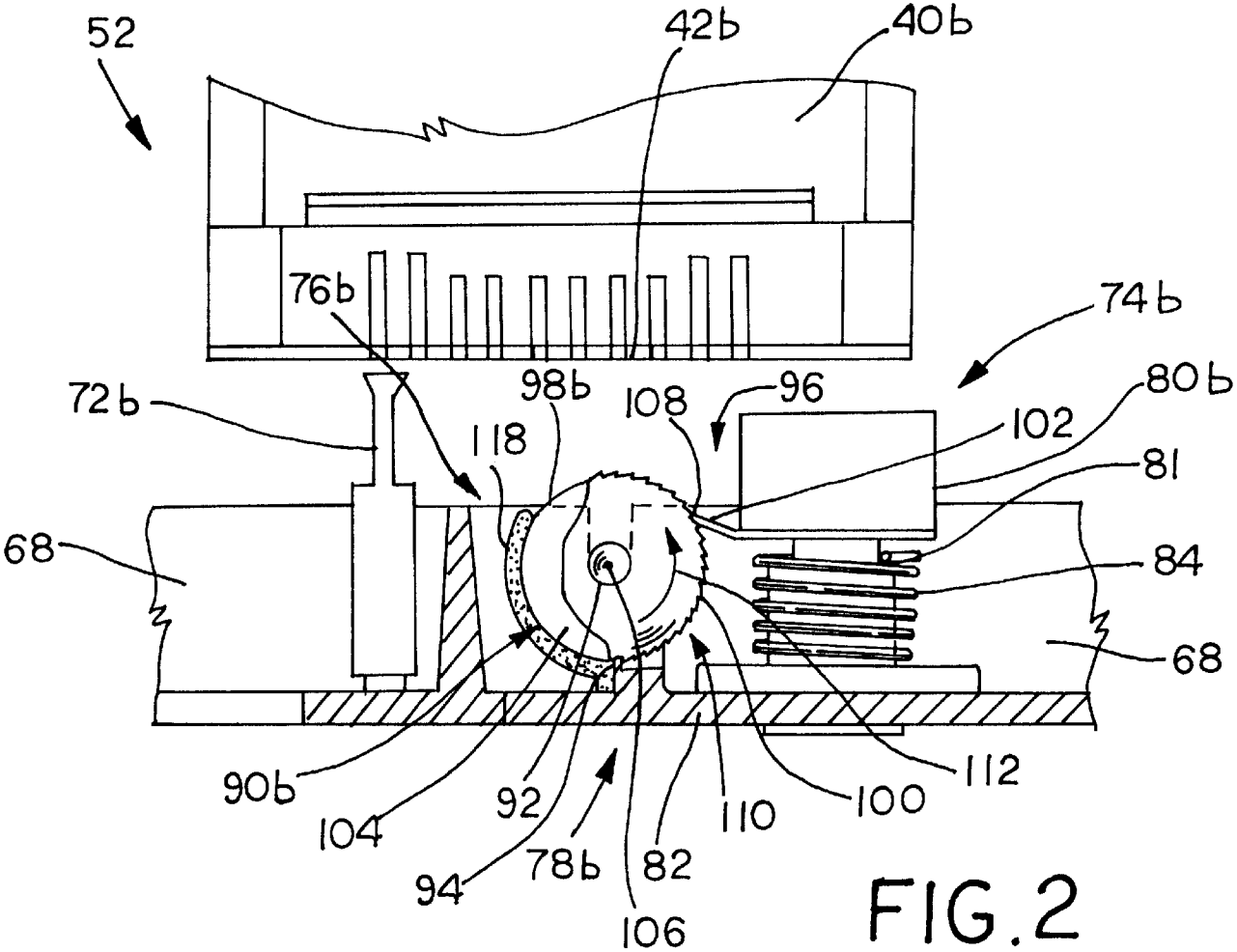
FIG. 2 is an enlarged sectional side view of a portion of the maintenance assembly of the invention, with a printhead in a spitting position.

Referring to FIGS. 1 and 2, each of print cartridges 38*a,* 38*b* includes an ink reservoir 40*a,* 40*b* and a printhead 42*a,* 42*b* respectively. Each of printheads 42*a,* 42*b* includes a nozzle plate containing at least two columns of ink jet nozzles for selectively ejecting ink from the corresponding ink reservoirs 40*a,* 40*b.* Although each of print cartridges 38*a,* 38*b* are shown as forming an integral unit, those skilled in the art will recognize that the reservoirs 40*a,* 40*b* may be mounted remotely from the printheads 42*a,* 42*b* and connected to the printhead via a conduit. In such a configuration, printhead carrier assembly 14 would not need to carry the ink reservoir.

As shown graphically by dashed lines in FIG. 1, printer 10 includes a print zone 44 and a maintenance zone 46. Maintenance zone 46 includes a maintenance start position 48 and a capping region 49. The reciprocating movement of printhead carrier assembly 14 along guide rail 32 is effected by a drive means (not shown) of a type known in the art, such as a belt coupled to a stepper motor. The movement of printhead carrier assembly 14 and the ejection of ink from print cartridges 38*a,* 38*b* are controlled by a microprocessor control means, types of which are known in the art. During operation, printhead carrier assembly 14 is moved by the drive means to position printheads 42*a,* 42*b* at various locations within the predetermined limits of permitted travel of printhead carrier assembly 14. Included in the limited travel of printhead carrier assembly 14 is print zone 44 and maintenance zone 46, including start position 48 and capping region 49.

Maintenance assembly 16 is attached to printer frame 12 above bottom frame member 18. Maintenance assembly 16 includes a maintenance frame 50 and a maintenance sled 52. Preferably, maintenance assembly 16 is located such that a left end 56 of maintenance sled 52 generally defines the location of maintenance start position 48 for printhead carrier assembly 14.

Maintenance frame 50 is a generally rectangular structure formed by vertical sides 58*a,* 58*b,* 58*c,* and 58*d.* Vertical side 58*a* includes two ramped surfaces 60*a,* 60*b,* and vertical side 58*b* includes two ramped surfaces 60*c,* 60*d.* Ramped surfaces 60*a,* 60*b,* 60*c,* 60*d* provide vertical support for maintenance sled 52. Each of ramped surfaces 60*a,* 60*b,* 60*c,* 60*d* is upwardly inclined towards vertical side 58*c* and each contains three distinct elevations: a printing elevation, a wiping elevation, and capping elevation.

Maintenance frame 50 further includes a print latch 62 pivotally coupled at the intersection of vertical sides 58*b,* 58*d.* Print latch 62 contains a stop surface 64 and a spring (not shown). Print latch 62 functions to actively control the placement of maintenance sled 52 along ramped surfaces 60*a,* 60*b,* 60*c,* 60*d.* When print latch 62 is in the open position sled 52 is allowed to migrate along ramped surfaces 60*a,* 60*b,* 60*c,* 60*d* to the lower, or printing, elevation. When print latch 62 is in the closed position sled 52 is prohibited from migrating along ramped surfaces 60*a,* 60*b,* 60*c,* 60*d* to the printing elevation. The spring biases print latch 62 towards the closed position. The structure and operation of print latch 62 is well known in the art.

Maintenance sled 52 is disposed within the open interior of maintenance frame 50. Maintenance sled 52 includes a generally rectangular frame 68 having four dowel members 70*a,* 70*b,* 70*c* and 70*d* which extend horizontally outward from rectangular frame 68. Dowel members 70*a,* 70*b,* 70*c,* 70*d* are supported by the corresponding ramped surfaces 60*a,* 60*b,* 60*c,* 60*d* on maintenance frame 50 and are guided along ramped surfaces 60*a,* 60*b,* 60*c,* 60*d* to raise or lower maintenance sled 52 relative to maintenance frame 50.

Maintenance sled 52 includes a pair of printhead wipers 72*a,* 72*b;* a pair of cap assemblies 74*a,* 74*b;* a pair of cavities 76*a,* 76*b* and a pair of rotary waste ink collection assemblies 78*a,* 78*b.* Each printhead wiper 72*a,* 72*b* is made of an elastic material, such as Texin 480-A (Mites, Inc.), and is secured to rectangular frame 68. Printhead wipers 72*a,* 72*b* remove excess ink from the exterior of the nozzles on printheads 42*a,* 42*b,* respectively.

Cavities 76*a,* 76*b,* are located in rectangular frame 68 to the right of printhead wipers 72*a,* 72*b,* respectively.

The structures and operation of the components of maintenance assembly 16 associated with printhead 42*b* will now be described in detail. It is to be understood that the discussion which follows is also applicable to the components of maintenance assembly 16 associated with printhead 42*a,* but for the sake of brevity, will not be discussed in detail below.

Cap assemblies 74*a,* 74*b* are substantially identical, and are positioned to the right of cavities 76*a,* 76*b,* respectively, and a discussion of one will be equally applicable to the other. Each cap assembly 74*a,* 74*b* includes a printhead cap 80*a,* 80*b.* FIG. 2 shows in detail the structure of cap assembly 74*b,* which is substantially identical to cap assembly 74*a*. For the sake of brevity, only the structure of cap assembly 74*b* will be discussed in detail below. As shown in FIG. 2, cap assembly 74*b* includes printhead cap 80*b* slidably mounted via post 81 to a base 82 for vertical movement, i.e., perpendicular movement with respect to base 82, which in turn is connected to rectangular frame 68 of maintenance sled 52. A spring 84 biases printhead cap 80*b* away from base 82.

Positioned within each of cavities 76*a*, 76*b* is a corresponding rotary waste ink collection assembly 78*a*, 78*b*, respectively. Rotary waste ink collection assemblies 78*a*, 78*b* are substantially identical, and a discussion of one will be equally applicable to the other. For the sake of brevity, only the structure of rotary waste ink collection assembly 78*b* will be described in detail below.

Referring again to FIG. 1, maintenance sled 52 further includes a capping tab 86 which extends vertically upward from rectangular frame 68. Capping tab 86 facilitates the movement of maintenance sled 52 to the wiping elevation or to the capping elevation along ramped surfaces 60*a*, 60*b*, 60*c*, 60*d* when contacted by carriage 36.

As shown in FIG. 1, rotary waste ink collection assemblies 78*a*, 78*b*, include a cylindrical drum 90*a*, 90*b*. FIG. 2 further shows an axle 92, a scraper 94 and a ratchet mechanism 96 for rotary waste ink collection assembly 78*b*.

Figure 3:
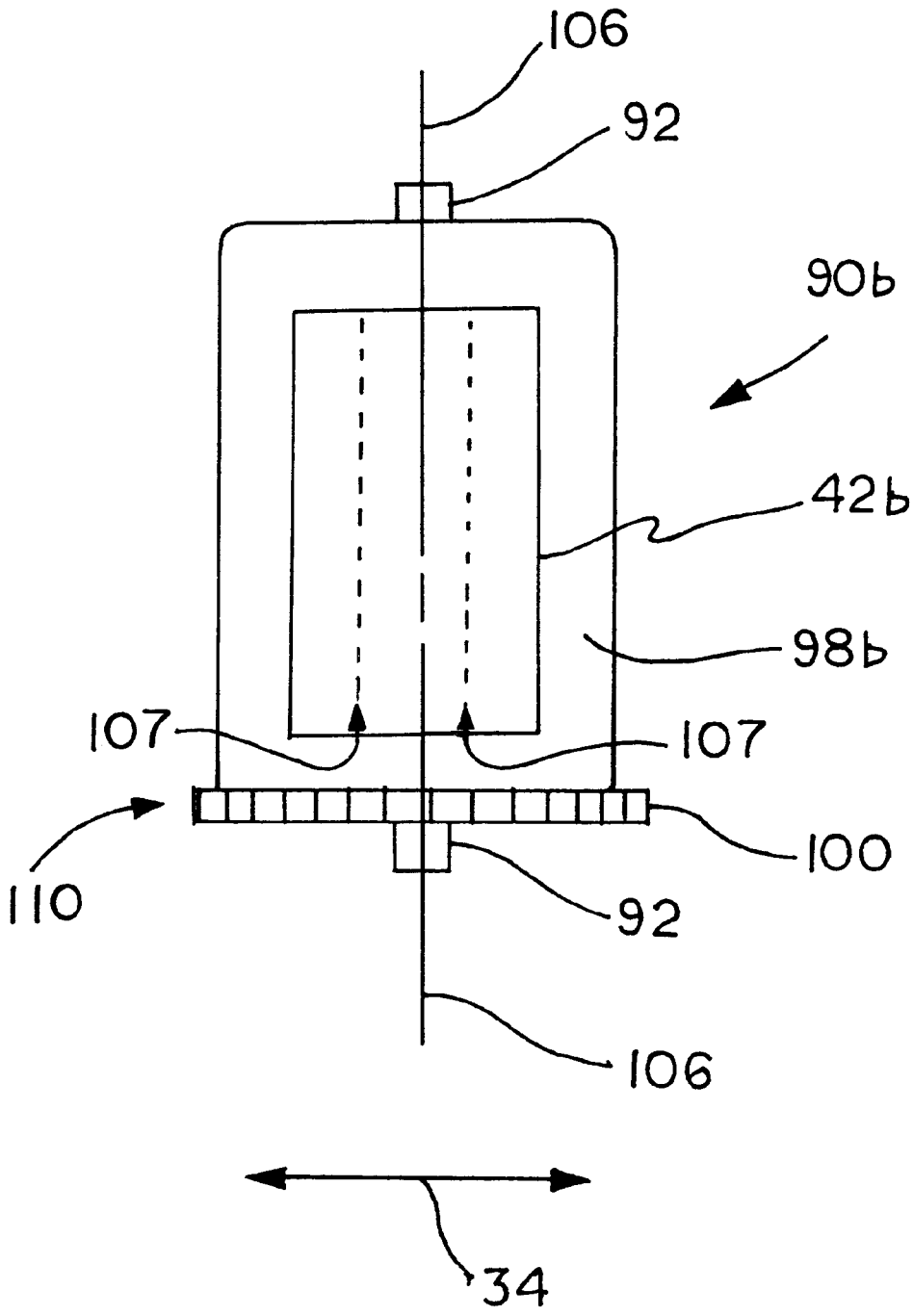
FIG. 3 is a graphical illustration of the relationship between the printhead and a cylindrical drum portion of the maintenance assembly when the printhead is in the spitting position.

Cylindrical drums 90*a*, 90*b* includes a cylindrical waste ink collection surface 98*a*, 98*b*, respectively. Ratchet mechanism 96 includes a ratchet gear 100 and a back-check member 102. Ratchet gear 100 is shown partially broken-away to expose a drum end 104 of cylindrical drum 90, to which ratchet gear 100 is attached. An axis 106 defines an axis of rotation of axle 92 which extends along axis 106 from opposing ends of cylindrical drum 90 to engage opposing sidewalls of rectangular frame 68 to rotatably mount cylindrical drum 90 and ratchet gear 100 within cavity 76*b*. Rectangular frame 68 includes a pair of holes or slots to mount axle 92 of cylindrical drum 90. Axis 106 about which cylindrical drum 90 rotates is located to be in a horizontal plane substantially perpendicular to the direction of reciprocation 34 of printhead carriage 36. As a result, and as graphically depicted in FIG. 3, cylindrical drum 90*b* is positioned such that axis of rotation 106 is substantially perpendicular to scanning direction 34 of reciprocating printheads 42*a*, 42*b*. Also, the axis of rotation 106 is such that print nozzles 107 of printhead 42*b*, which are arranged in columns, are substantially uniformly spaced from cylindrical waste ink collection surface 98*b* of the cylindrical drum 90*b* during a printhead spitting, or purging, operation which helps to control misting of the purged ink. In some applications, however, it may be desirable for the axis of rotation 106 of cylindrical drum 90*b* to be slightly inclined with respect to a plane of base 82.

Referring again to FIG. 2, back-check member 102 is mounted to printhead cap 80*b* and is movable therewith. Back-check member 102 includes a distal end 108 which extends outwardly and upwardly from printhead cap 80*b*. Distal end 108 is sized and positioned to engage the teeth 110 of ratchet gear 100 to permit a one-way rotation of ratchet gear 100, and in turn cylindrical drum 90, in the direction indicated by arrow 112, and also prevents a rotation of cylindrical drum 90 in a direction opposite to the direction depicted by arrow 112.

Referring to FIG. 1, during use of printer 10, printing operations occur in a conventional manner that is well understood in the art. A sheet (S) of print media, such as paper, is carried under printheads 42*a*, 42*b*, but above bottom frame member 18. The sheet (S) is carried by a series of rollers (not shown) in the direction shown by arrow 33. As the sheet is being carried, printheads 42*a*, 42*b* reciprocally traverse print zone 44. Under the control and at locations selected by a microprocessor control means, print cartridges 38*a*, 38*b* selectively eject ink from the respective nozzles of printheads 42*a*, 42*b* onto sheet (S).

During a maintenance operation, printheads 42*a*, 42*b* are moved into maintenance zone 46 to have a maintenance cycle performed. Two types of maintenance cycles are possible: a printing maintenance cycle and a printhead storage maintenance cycle. Both types of maintenance cycles, i.e., the printing maintenance cycle and the printhead storage maintenance cycle, are effected by maintenance assembly 16. The operation of rotary waste ink collection assemblies 78*a*, 78*b* will now be discussed in relation to the maintenance cycles, i.e., the printing maintenance cycle and printhead storage maintenance cycle, and will be discussed with reference to FIGS. 1–4.

Figure 4:
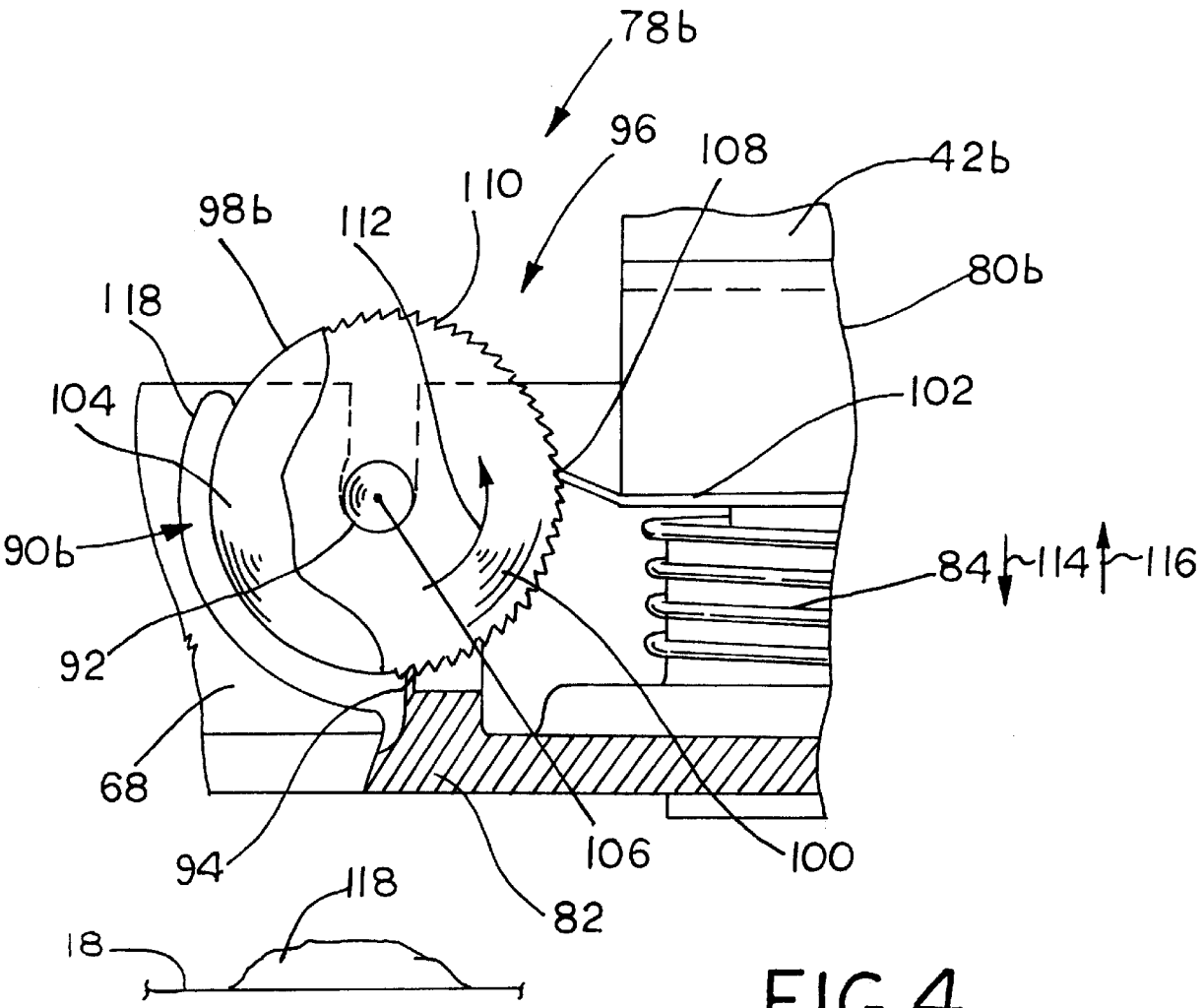
FIG. 4 is an enlarged sectional side view of a portion of the maintenance assembly of the invention, with the printhead in the capping position.

FIG. 2 shows the orientation of printhead cap 80*b* and back-check member 102 when printhead 42*b* is in the spitting position. FIG. 4 shows the orientation of printhead cap 80*b* and back-check member 102 when printhead 42*b* is in the capping position and after maintenance sled 52 is placed at the capping elevation. Some of the discussion that follows describes the details of operation of only rotary waste ink collection assembly 78*b* shown in FIGS. 2 and 4, but it is to be understood that the discussion that follows directed specifically to rotary waste ink collection assembly 78*b* is equally applicable to the operation of rotary waste ink collection assembly 78*a*.

In a printing maintenance cycle, printhead carrier assembly 14 moves to the right along guide rail 32 to maintenance zone 46. Printhead carrier assembly 14 passes maintenance start position 48 and as printhead carrier assembly 14 moves farther to the right, the rightward leading side of carriage 36 contacts capping tab 86 of maintenance sled 52. This contact causes maintenance sled 52 to move to the right with the printhead carrier assembly 14. The rightward movement of carriage 36 causes print latch 62 to momentarily reside in the open position thereby releasing maintenance sled 52 from the lower, or printing, elevation. Also, the rightward movement of carriage 36 raises maintenance sled 52 to the wiping, or mid-level, elevation because dowel members 70*a*, 70*b*, 70*c*, 70*d* of maintenance sled 52 are guided along ramped surfaces 60*a*, 60*b*, 60*c*, 60*d*.

Once maintenance sled 52 reaches the wiping elevation, print latch 62 resumes the closed position thereby impeding maintenance sled 52 from migrating back down ramped surfaces 60*a*, 60*b*, 60*c*, 60*d* to the printing elevation due to stop surface 64 on print latch 62. After print latch 62 resumes the closed position, printhead carrier assembly 14 begins to travel back to the left towards print zone 44. As printhead carrier assembly 14 moves farther to the left, the nozzles of printheads 42*a*, 42*b* are wiped by printhead wipers 72*a*, 72*b* to remove excess ink from the nozzles and a portion of the leftward leading side of carriage 36 contacts print latch 62 causing print latch 62 to assume the open position. Once print latch 62 is in the open position, dowel members 70*a*, 70*b*, 70*c*, 70*d* of maintenance sled 52 migrate down ramped surfaces 60*a*, 60*b*, 60*c*, 60*d* from the mid-level wiping elevation to the lower printing elevation due to gravity.

Print cartridges 38*a*, 38*b* are positioned over discharge cavities 76*a*, 76*b*, respectively. Ink is ejected from the nozzles in printheads 42*a*, 42*b*. The ejected ink, or waste ink 118, falls onto the cylindrical waste ink collection surfaces 98*a*, 98*b* of each of cylindrical drums 90*a*, 90*b* of rotary waste ink collection assemblies 78*a*, 78*b*. After ink is ejected, printhead carrier assembly 14 enters print zone 44 ready to begin printing.

Ink may be ejected from the nozzles of printheads 42*a*, 42*b* while maintenance sled 52 is in the mid-level wiping elevation or the lower level printing elevation.

The printhead storage maintenance cycle is generally analogous to the printing maintenance cycle, except that printhead carrier assembly 14 does not stop its rightward motion when maintenance sled 52 is at the wiping elevation. Instead, printhead carrier assembly 14 continues to move to the right, thereby further moving maintenance sled 52 to the right until dowel members 70*a*, 70*b*, 70*c*, 70*d* of maintenance sled 52 are at the capping, or upper, elevation of ramp surfaces 60*a*, 60*b*, 60*c*, 60*d*.

Referring to FIG. 4, when maintenance sled 52 moves to the capping, or upper, position, printhead cap 80*b* engages printhead 42*b* and printhead cap 80*b* is forced relatively downward in the direction indicated by arrow 114, e.g. vertically, toward base 82, thereby placing spring 84 in a state of compression. Since distal end 108 of back-check member 102 extends outwardly and upwardly from printhead cap 80*b*, distal end 108 passes over teeth 110 during the movement in the direction of arrow 114 without effecting rotation of cylindrical drum 90*b*. When maintenance sled 52 is at the capping elevation, caps 80*a*, 80*b*, respectively form an air seal around the nozzles on printheads 42*a*, 42*b* to prevent the ink on the nozzles from drying.

Once printhead carrier assembly 14 begins to move to the left toward print zone 44, maintenance sled 52 migrates down ramp surfaces 60*a*, 60*b*, 60*c* 60*d* from the capping elevation to the wiping elevation, thereby disengaging caps 80*a*, 80*b* from the respective printheads 42*a*, 42*b*. As stated earlier, when printheads 42*a*, 42*b* are positioned over cylindrical waste ink collection surfaces 98*a*, 98*b* of cylindrical drums 90*a*, 90*b*, printheads 42*a*, 42*b* eject, or spit, waste ink 118 from the nozzles onto cylindrical waste ink collection surfaces 98*a*, 98*b* and are wiped by printhead wipers 72*a*, 72*b* as printhead carrier assembly 14 moves to the left. In addition, as caps 80*a*, 80*b* are disengaging printheads 42*a*, 42*b*, their respective rotary waste ink collection assemblies are activated for rotation.

Referring again to FIGS. 1 and 4, as maintenance sled 52 begins to migrate down ramp surfaces 60*a*, 60*b*, 60*c* 60*d* from the capping elevation to the wiping elevation, distal end 108 of back-check member 102 engages teeth 110, and both printhead cap 80*b* and back-check member 102 move relatively upwardly (e.g., vertically) with respect to base 82 in the direction depicted by arrow 116 to cause cylindrical drum 90*b* to rotate in the direction of arrow 112. As a result of the rotation of cylindrical drum 90*b*, a portion of the waste ink 118 collected on cylindrical waste ink collection surface 98*b* is removed by scraper 94, which then falls toward printer bottom frame member 18. Scraper 94 is positioned so as to remove at least a portion of the waste ink 118. As shown in FIG. 4, scraper 94 is positioned below cylindrical drums 90*a*, 90*b*; however, scraper 94 may be positioned along side, above, or even in contact with cylindrical drums 90*a*, 90*b*. It should be noted that the position of scraper 94 is limited only to the extent that it should not interfere with the ejection of ink from printheads 42*a*, 42*b*.

Although the invention is described above in relation to a printing system having two printheads, those skilled in the art will recognize that the invention is equally applicable to and adaptable to a system having a single printhead, or a system having more than two printheads.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A maintenance station for an ink jet printer, comprising:

a frame;

a device rotatably coupled to said frame for collecting waste ink; and a ratchet drive assembly coupled to said frame for effecting rotation of said device, wherein said ratchet drive assembly comprises a ratchet gear coupled to said device, said ratchet gear having a plurality of teeth, and a back-check member having a distal end which engages said teeth for effecting a rotation of said device in a first direction.

2. A The maintenance station of claim 1, wherein said back-check member prevents a rotation of said device in a direction opposite to said first direction.

3. The maintenance station of claim 1, further comprising a scraper for removing at least a portion of said waste ink from said device as said device is rotated.

4. The maintenance station of claim 3, wherein said device is a cylindrical drum having an end.

5. The maintenance station of claim 4, wherein said ratchet gear is attached to said end of said cylindrical drum.

6. A maintenance station for an ink jet printer, comprising:

a frame;

a device rotatably coupled to said frame for collecting waste ink;

a ratchet drive assembly coupled to said frame for effecting rotation of said device, wherein said ratchet drive assembly comprises a ratchet gear coupled to said device, said ratchet gear having a plurality of teeth, and a back-check member having a distal end which engages said teeth for effecting a rotation of said device in a first direction; and a printhead capping assembly coupled to said frame, said printhead capping assembly having a printhead cap for engaging said printhead during a capping operation, said printhead capping assembly being coupled to said back-check member.

7. The maintenance station of claim 6, wherein said rotation of said device is effected as said printhead cap is moved in a vertical direction.

8. The maintenance station of claim 6, wherein said rotation of said device is effected as said printhead cap disengages said printhead.

9. A maintenance station for an ink jet printer having a carriage assembly for moving an ink jet printhead having a column of nozzles along a linear scanning path, comprising:

a frame;

a printhead capping assembly coupled to said frame, said printhead capping assembly having a printhead cap for engaging said printhead during a capping operation, said printhead capping assembly being located on said frame along said linear scanning path of said ink jet printhead; and a cylindrical drum having a cylindrical surface, said cylindrical drum being rotatably coupled to said frame and positioned adjacent said printhead capping assembly, said cylindrical drum being orientated such that an axis of rotation of said cylindrical drum is substantially perpendicular to said linear scanning path of said ink jet printhead.

10. The maintenance assembly of claim 9, wherein said cylindrical drum is further oriented to provide a substantially uniform spacing between said column of nozzles and said cylindrical surface of said cylindrical drum.

11. The maintenance station of claim 9, further comprising a ratchet drive assembly coupled to said frame for effecting a rotation of said cylindrical drum.

12. A maintenance station for an ink jet printer having a carriage assembly for moving an ink jet printhead having a column of nozzles along a linear scanning path, comprising:

a frame;

a printhead capping assembly coupled to said frame, said printhead capping assembly having a printhead cap for engaging said printhead during a capping operation, said printhead capping assembly being located on said frame along said linear scanning path of said ink jet printhead;

a cylindrical drum having a cylindrical surface, said cylindrical drum being rotatably coupled to said frame and positioned adjacent said printhead capping assembly, said cylindrical drum being orientated such that an axis of rotation of said cylindrical drum is substantially perpendicular to said linear scanning path of said ink jet printhead; and a ratchet drive assembly coupled to said frame for effecting a rotation of said cylindrical drum, wherein said ratchet drive assembly comprises a ratchet gear coupled to said cylindrical drum, said ratchet gear having a plurality of teeth, and a back-check member coupled to said capping assembly, said back-check member having a distal end which engages said teeth.

13. The maintenance station of claim 12, wherein said rotation of said cylindrical drum is effected as said printhead capping assembly disengages said printhead.

14. The maintenance station of claim 13, wherein said cylindrical drum is located such that said nozzles are positioned to be substantially uniformly spaced from said cylindrical surface of said cylindrical drum during a nozzle purging operation.

15. A printer for printing with an ink jet printhead, comprising:

a printer frame;

a carriage assembly coupled to said printer frame, said carriage assembly moving said ink jet printhead along a linear scanning path;

a maintenance assembly frame coupled to said printer frame;

a device rotatably coupled to said maintenance frame for collecting waste ink ejected by said printhead; and a ratchet drive assembly coupled to said maintenance frame for effecting rotation of said device, said ratchet drive assembly comprises a ratchet gear coupled to said device, said ratchet gear having a plurality of teeth, and a back-check member having a distal end which engages said teeth for effecting a rotation of said device in a first direction.

16. The printer of claim 15, wherein said back-check member prevents a rotation of said device in a direction opposite to said first direction.

17. The printer of claim 15, further comprising a printhead capping assembly coupled to said maintenance frame, said printhead capping assembly having a printhead cap for engaging said printhead during a capping operation, said printhead capping assembly being coupled to said back-check member to effect movement of said back-check member.

18. The printer of claim 17, wherein said rotation of said device is effected as said printhead cap disengages said printhead after a printhead capping operation.

19. The printer of claim 15, wherein said device is a cylindrical drum having an end.

20. The printer of claim 19, further comprising a ratchet gear attached to said end of said cylindrical drum.

21. The printer of claim 15, further comprising a scraper for removing at least a portion of said waste ink from said device as said device is rotated.

22. The printer of claim 21, wherein said device comprises a cylindrical drum.

* * * * *